US009052127B2

(12) United States Patent
Lee et al.

(10) Patent No.: US 9,052,127 B2
(45) Date of Patent: Jun. 9, 2015

(54) REFRIGERATOR HAVING AUXILIARY COOLING DEVICE

(75) Inventors: Sangbong Lee, Seoul (KR); Taehee Lee, Seoul (KR); Younghoon Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 334 days.

(21) Appl. No.: 13/611,779

(22) Filed: Sep. 12, 2012

(65) Prior Publication Data

US 2013/0160484 A1 Jun. 27, 2013

(30) Foreign Application Priority Data

Dec. 21, 2011 (KR) ..... 10-2011-0138851

(51) Int. Cl.
*F25D 11/04* (2006.01)
*F25B 29/00* (2006.01)

(52) U.S. Cl.
CPC ..... *F25B 29/003* (2013.01)

(58) Field of Classification Search
USPC ..... 62/228.2, 340, 434, 439, 440, 452, 515, 62/530
See application file for complete search history.

(56) References Cited

U.S. PATENT DOCUMENTS

| | | | | |
|---|---|---|---|---|
| 2,682,756 | A | 7/1954 | Clark et al. | 62/117.3 |
| 3,077,749 | A | 2/1963 | Jung et al. | 62/419 |
| 3,309,895 | A | 3/1967 | Tamada | 62/475 |
| 4,459,826 | A | 7/1984 | Hirano et al. | 62/430 |
| 4,928,501 | A * | 5/1990 | Negishi | 62/406 |
| 4,964,279 | A | 10/1990 | Osborne | 62/59 |
| 5,527,105 | A | 6/1996 | Riach, Jr. | 312/406 |
| 5,860,287 | A * | 1/1999 | O'Neal | 62/201 |
| 6,397,618 | B1 * | 6/2002 | Chu et al. | 62/259.2 |
| 6,789,392 | B1 | 9/2004 | Miller et al. | 62/130 |
| 8,794,026 | B2 | 8/2014 | Kuehl et al. | 62/434 |
| 2003/0209025 | A1 | 11/2003 | Lee | 62/272 |
| 2009/0194257 | A1 * | 8/2009 | Niu et al. | 165/104.17 |
| 2010/0042476 | A1 | 2/2010 | Gauri | 705/10 |
| 2010/0328882 | A1 | 12/2010 | Campbell et al. | 361/689 |

FOREIGN PATENT DOCUMENTS

| | | |
|---|---|---|
| CN | 2143311 | 10/1993 |
| CN | 1187606 | 7/1998 |
| CN | 1685183 | 10/2005 |
| CN | 1880896 | 12/2006 |
| DE | 10 2004 035 017 A1 | 2/2006 |

(Continued)

OTHER PUBLICATIONS

European Search Report dated Apr. 9, 2014 issued in Application No. 12187590.0.

(Continued)

*Primary Examiner* — Melvin Jones
(74) *Attorney, Agent, or Firm* — Ked & Associates, LLP

(57) ABSTRACT

A refrigerator having an auxiliary cooling device is disclosed. The refrigerator may include a cabinet that includes a storage compartment to preserve food and a pipe for refrigerant arranged in the storage compartment to cool the storage compartment. a phase change material may provide auxiliary cooling for the storage compartment when the pipe is not operational. An enclosure for the phase change material may be provided around the pipe. The pipe may have a serpentine shape and the enclosure may be formed of a flexible material and shaped to corresponding to a shape of the pipe.

17 Claims, 7 Drawing Sheets

(56) References Cited

FOREIGN PATENT DOCUMENTS

| | | | |
|---|---|---|---|
| EP | 0 974 794 | A2 | 1/2000 |
| GB | 2 094 459 | A | 9/1982 |
| JP | 2-9779 | | 1/1990 |
| JP | 6-26748 | | 2/1994 |
| JP | 2003-329317 | A | 11/2003 |
| JP | 2006-138605 | A | 6/2006 |
| JP | 2007-192448 | | 8/2007 |
| WO | WO 2006/008276 | A1 | 1/2006 |
| WO | WO 2010/123405 | A1 | 10/2010 |

OTHER PUBLICATIONS

Chinese Office Action issued in related Application No. 201210408450.5 dated Aug. 26, 2014.

Chinese Office Action issued in related Application No. 201210252703.4 dated May 6, 2014.

U.S. Office Action issued on Dec. 15, 2014 in co-pending U.S. Appl. No. 13/548,141.

* cited by examiner

REFRIGERATOR HAVING AUXILIARY COOLING DEVICE

CROSS-REFERENCE TO RELATED APPLICATION(S)

Pursuant to 35 U.S.C. §119(a), this application claims the benefit of earlier filing date and right of priority to Korean Application No. 10-2011-0138851, filed on Dec. 21, 2011, whose entire disclosure is hereby incorporated by reference.

BACKGROUND

1. Field

A refrigerator having an auxiliary cooling device disclosed herein.

2. Background

Refrigerators having auxiliary cooling devices are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

A refrigerator having an auxiliary cooling device is disclosed herein. The auxiliary cooling device may include a thermal storage material such as, for example, a phase change material (PCM), that stores thermal energy during normal operation for use during a power failure to cool the refrigeration compartments. The auxiliary cooling device (thermal storage device) may include a structure that enhances heat exchange efficiency between a refrigerant and an evaporator for the refrigerator.

Generally, a refrigerator is an electric appliance that cools an inner space thereof by absorbing heat using a working fluid (refrigerant) to freeze or refrigerate food or other types of perishable items. The working fluid may circulate in a cooling cycle which may include a compressor, a condenser, an expander and an evaporator to cool an inner compartment of the refrigerator. The compressor may be arranged in a lower rear portion of a cabinet and the evaporator may be arranged on a rear wall of a freezer compartment provided in the refrigerator, for example, and may operate to absorb heat from the freezer compartment.

During normal operation, when electrical power is available to drive the compressor, cold air may be constantly supplied by the cooling cycle to maintain the temperature inside the refrigerator. However, if the cooling cycle cannot operate because of, for example, a power outage, failure of the power supply, a malfunction of the compressor, or the like, the temperature inside the refrigerator may increase.

Particularly, the temperature inside a refrigeration compartment where food is subject to spoilage may quickly rise. Food stored in refrigeration compartments are more sensitive to temperature increases and may be more susceptible to spoilage than food stored in the freezer compartment. Accordingly, the refrigerator as broadly described and embodied herein prevents or reduces a rise in temperature inside the refrigeration compartment when the cooling cycle in not operational, e.g., during power failures or faults. Moreover, the refrigerator may include a case for a phase change material which may protect the phase change material during normal use of the freezer compartment as well as improve performance of the PCM by increasing a contact area with an evaporator provided therein.

A refrigerator will be described in detail in reference to the accompanying drawings as follows. Reference may now be made in detail to specific embodiments, examples of which may be illustrated in the accompanying drawings. Wherever possible, same reference numbers may be used throughout the drawings to refer to the same or like parts.

Figure 1:
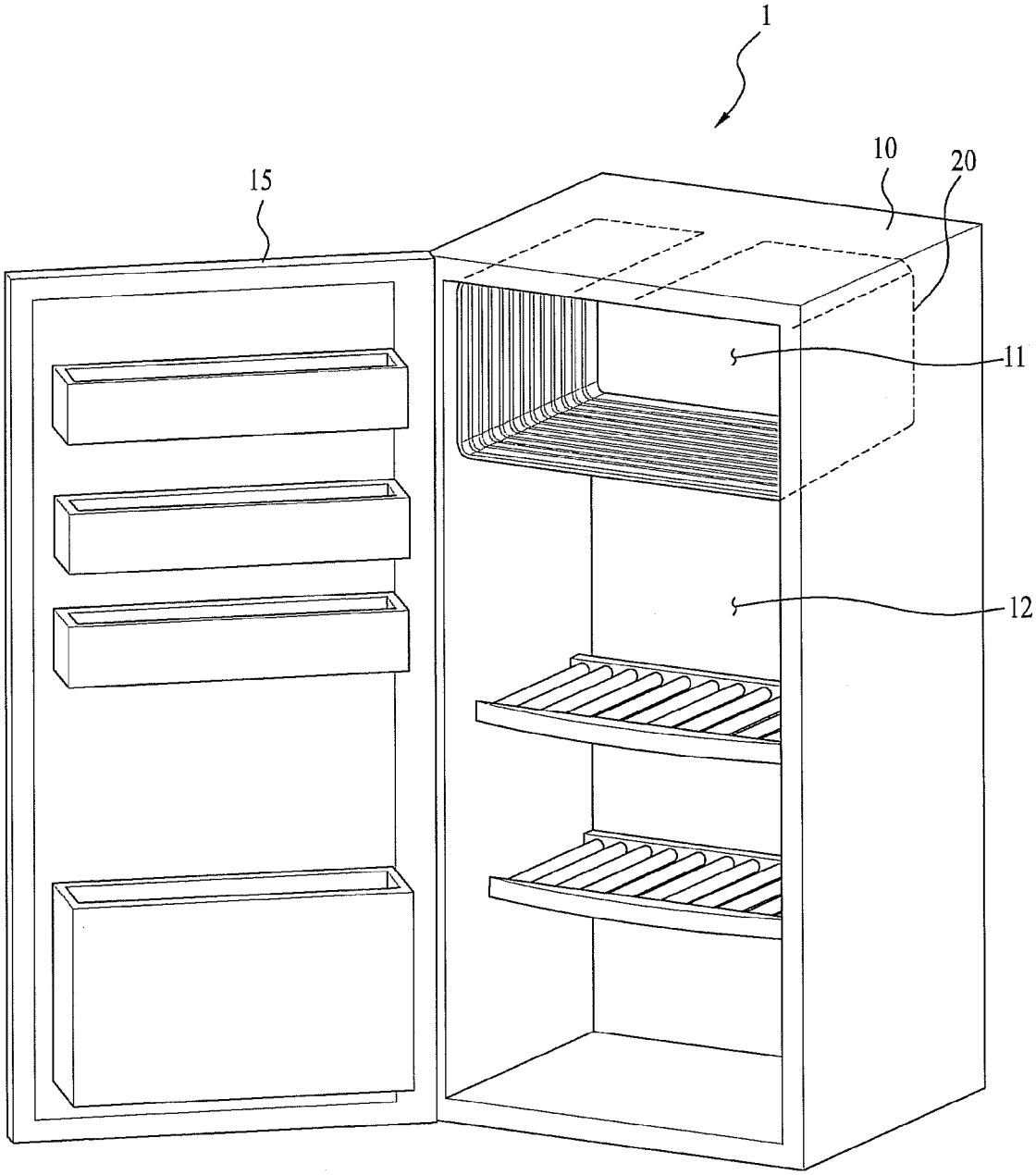
FIG. 1 is a perspective view of a refrigerator.

FIG. 1 is a perspective view of a refrigerator. The refrigerator 1 may include a refrigerator cabinet 10, an evaporator 20 and a door 15. The refrigerator 1 includes a storage compartment provided therein and may maintain the temperature inside the storage compartment using a cooling cycle to preserve perishable items stored therein. The door 15 may be attached to the cabinet 10 to provide access to the storage compartment.

The refrigerator cabinet 10 may have an open front and the storage compartment may be provided therein to preserve the food. The refrigerator cabinet 10 may formed to have one or more storage compartments that can be kept at prescribed temperatures. For example, the refrigerator 1 configured for residential use may be divided into a freezer compartment 11 having an inner temperature maintained below 0° C. (32° F.) and a refrigeration compartment having an inner temperature maintained above 0° C. and lower than a prescribed temperature (for example, approximately 10° C. or 50° F.).

The door 15 may be a single door as shown in FIG. 1 or it may include two or more doors if necessary. The number, size, and configuration or the door 15 may be determined based on desired functional and/or aesthetic considerations.

The door 15 may rotate on a hinge to be open and closed. Moreover, a drawer type storage compartment may be provided to slide in and out of the refrigerator cabinet 10. In this instance, the door 15 may be pushed or pulled to be open and closed. The number of doors 15 may be variable according to a number of partitioned spaces in the refrigerator cabinet 10.

The evaporator 20 is one of that devices included in the cooling cycle and it may be mounted in the storage compartment to supply cold air to the storage compartment. The cooling cycle may include the condenser and the compressor as well as the evaporator 20. Refrigerant may undergo heat exchange, while circulating through the evaporator 20, the condenser and the compressor, in order, to maintain the temperature inside the storage compartment uniformly.

The refrigerant may be liquefied in the condenser and the compressor and may be vaporized in the evaporator 20 to absorb a latent heat to lower the temperature of the storage compartment. In other words, heat exchange with the inside of the storage compartment is performed in the evaporator 20. To enhance the heat exchange efficiency, unevenness (grooves or ridges) is formed on a surface of the evaporator 20. A surface of the evaporator 20 shown in FIG. 1 may be formed to be uneven to broaden the surface area of the evaporator 20.

The refrigerator 1 may be classified into a direct cooling type and an indirect cooling type based on a method of transferring cold air to the storage compartment. In the indirect cooling type, a fan is driven to forcibly circulate cold air to spread the cold air. The indirect cooling type is typically used in a large-sized refrigerator. In the direct cooling type, no fan is used and an evaporator 20 may be embedded in a large area of a wall to directly transfer the heat of the evaporator 20 to the storage compartment of the refrigerator 1. The direct cooling type is typically used in a small-sized refrigerator (e.g., a kim-chi refrigerator).

The inner temperature can be maintained uniform, without being changed easily in the direct cooling type, compared with the indirect cooling type. Accordingly, the direct cooling type refrigerator may have an advantage in preserving a taste of various types of foods because the inner temperature can be maintained uniform without easily changed. The direct cooling type refrigerator may also produce less noise as well as consume less power because it does not have to drive the fan.

The evaporator 20 may be formed in one or more wall surfaces of the freezer compartment 11. As the number of the wall surfaces where the evaporator 20 is mounted increases, the cooling effect may be enhanced. The refrigerator as shown in FIG. 1 is a direct cooling type. Here, the evaporator 20 may be arranged at a top surface, a bottom surface and both lateral surfaces of the freezer compartment 11.

The indirect cooling type may generate cold air from a predetermined area and circulate the cold air by using the fan. Accordingly, the indirect cooling type can transfer the cold air throughout the storage compartment in a large-sized refrigerator. Frost may be formed at only specific areas in the indirect cooling type and the frost can be prevented by a defrosting heater provided in the refrigerator.

An upper portion of the refrigerator may be a freezer compartment 11 having top, bottom and lateral surfaces surrounded by the evaporator 20 and a lower portion thereof may be a refrigeration compartment 12 located under the freezer compartment 11. In this instance, a partition wall may be further provided to partition the inside of the refrigerator into the freezer compartment 11 and the refrigeration compartment 12. Two doors 15 may be provided to open and close the freezer compartment 11 and the refrigeration compartment 12, respectively.

Typically, a refrigerator maintains the inner temperature to be uniform only when the cooling cycle is operated, and the cooling cycle requires power to compress the refrigerant. Accordingly, in the event of a power failure, the cooling cycle may fail to operate, and hence allowing the inner temperature of the refrigeration compartment in the refrigerator to rise. To prevent that, a thermal storage material such as a PCM may be used.

A PCM is a material in which a state may be changed at predetermined temperatures. For example, the state of the PCM may be changed to gas from liquid, to a solid from a liquid or to a solid from gas at predetermined temperatures. The PCM has no temperature change at the melting point or boiling point and a large amount of energy is consumed or emitted to change the phase. Accordingly, the may be used for storing the energy in a predetermined range of temperatures. Especially, the PCM may be provided adjacent to the evaporator 20 to store cold air.

The phase of the PCM may be changed into a solid from a liquid or into a liquid from a solid. Accordingly, the PCM must be accommodated in a predetermined receptor. The receptor may be an enclosure or case to hold the PCM. Simply for discussion purposes, the receptor is referred to hereinafter as a casing or a PCM casing.

The PCM casing 30, 35 may be hollow such that the PCM may be injected into the casing. The PCM casing 30, 35 may be a hard case formed of an anticorrosive material (e.g., plastic) and formed by, for example, injection molding. Here, the casing may be an airtight enclosure for the so as to prevent leaks regardless of the state of the PCM (e.g., liquid, gas).

Figure 3:
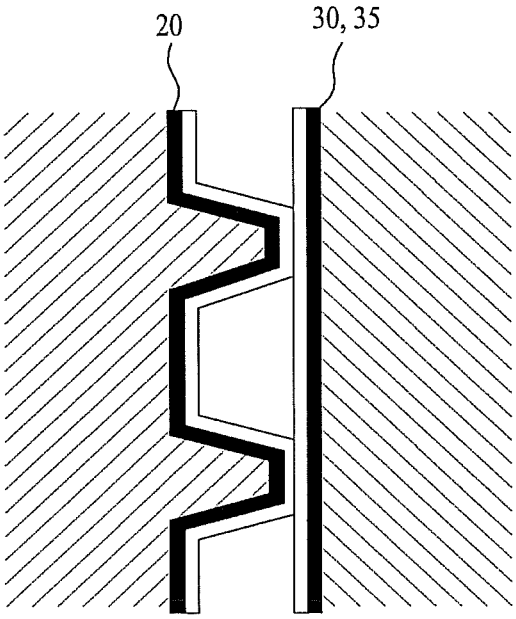
FIG. 3 is a sectional view illustrating a state of contact between an enclosure for a phase change material and an evaporator according to one embodiment.

However, the surface of the evaporator 20 may be uneven due to pipes formed therein for the refrigerant to flow. Such a hard case may not closely contact the surface of the evaporator 20, particularly when the surfaces of the evaporator 20 is uneven as illustrated in FIG. 3. In this case, the contact area between the evaporator 20 and the PCM may be reduced, lowering the efficiency of thermal transfer from the evaporator 20 to the PCM. Accordingly, a greater amount of time may be necessary for the PCM to store the energy for generating the cold air.

As a result, the PCM casing 30, 35 may be molded or otherwise formed to have a shape that corresponds to the shape of the surface of the evaporator 20. For example, as illustrated in FIG. 4, a surface of the PCM casing 30 and 35 may be molded to have a shape substantially the same as the unevenness of the evaporator 20, and hence increasing the contact area for thermal energy transfer.

While one surface of the casing 30, 35 is placed to face the evaporator 20, an opposite surface of the casing 30, 35 may serve as the inner surface of the storage compartments 11, 12. This exposed surface that faces the inner freezer or refrigeration compartments 11, 12 may have a prescribed texture or pattern. The prescribed texture or pattern may be provided for aesthetic as well as functional purposes. For example, raised ridges or channels may be provided to prevent stored items from contacting condensation, ridges or the like may be provided to improve the structural strength of the storage compartment surfaces, or the surface may be textured, for example, to minimize the formation of condensation on the surfaces of the storage compartments 11, 12. The hard casing 30, 35 may be formed of resins or another appropriate type of material that allows formation of a rigid structure. Moreover, various processes such as injection molding may be employed to manufacture the casing 30, 35 such that detailed features may be integrated into the structure of the casing as described above.

Figure 4:
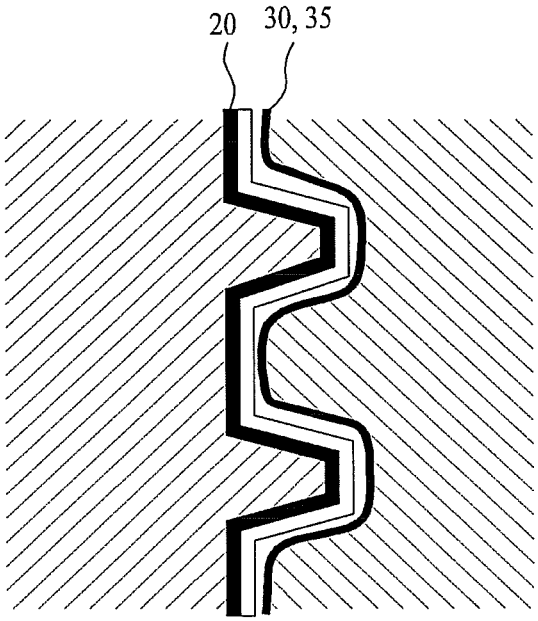
FIG. 4 is a sectional view illustrating a state of contact between an enclosure for a phase change material and an evaporator according to another embodiment.

In one embodiment, the PCM casing 30, 35 may be formed of a flexible or pliable material which may flex to conform to the shape of the evaporator 20, as illustrated in FIG. 4. When the casing 30, 35 is positioned adjacent to the evaporator 20, the flexible surfaces of the casing 30, 35 may allow the PCM casing 30, 35 to be more closely positioned to the surface of the evaporator 20, further increasing the contact area between the casing 30, 35 and the surface of the evaporator 20. For example, a vinyl PCM casing 30 and 35 may be filled with the PCM and may be closed airtight to form a vinyl pack. The vinyl pack may be placed against the evaporator 20 to conform to the shape of the evaporator 20. The PCM casing 30 and 35 may be formed of various types of materials which are flexible, pliable, elastic and/or supple as well as having a high thermal transfer efficiency.

While one surface of the casing 30, 35 is placed to face the evaporator 20, an opposite surface of the casing 30, 35 may face the storage compartments 11, 12. This surface may serve as the inner surface of the storage compartments 11, 12. The flexible material of the casing 30, 35 may be exposed to the user and items stored in the storage compartments 11, 12. The exposed surface of the PCM casing 30 and 35 may be formed of a different material having a different amount of flexibility. For example, the surface facing the evaporator 20 may be more flexible than the exposed surface since the surface facing the evaporator must conform to the shape of the evaporator 20, while the exposed surface may be formed of a more rigid material to provide improved durability as well as protection for the PCM inside the casing 30, 35.

In another embodiment, the surfaces of the PCM casing 30, 35 that faces the evaporator 20 as well as the storage compartment 11, 12 may be formed of the same material, with the same amount of flexibility. In this instance, a frame for the PCM may be arranged adjacent to the exposed surface of the PCM casing 30, 35, as illustrated in FIG. 2.

Here, the PCM casing 30, 35 may be formed of, for example, a vinyl or another appropriate type of flexible material. The evaporator 20 may be coupled to the refrigerator cabinet 10, and the PCM casing 30, 35 may be provided adjacent to the evaporator 20 to conform to the shape of the evaporator 20. The vinyl PCM casing 30, 35 may be provided adjacent to one or more of the top, bottom or lateral surfaces of the evaporator 20. Alternatively, the vinyl PCM casing 30, 35 may be arranged on each of the surfaces of the evaporator 20.

Figure 2:
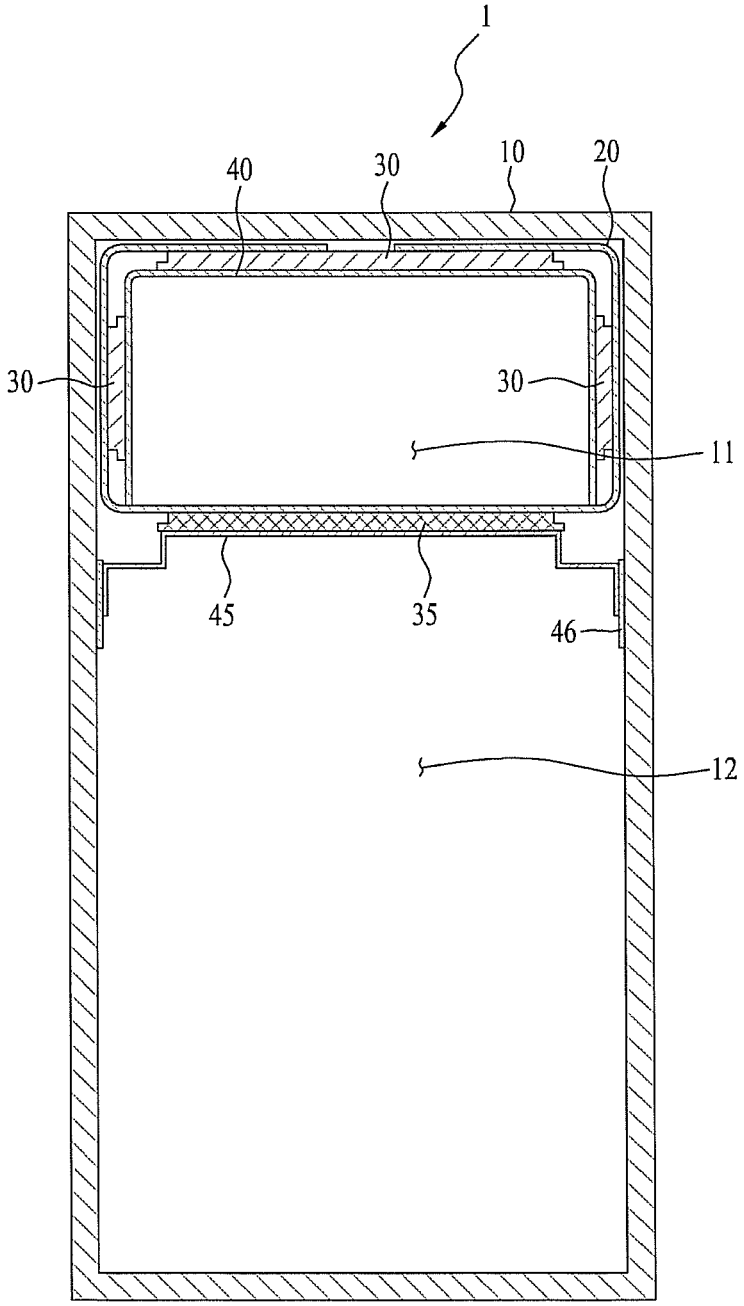
FIG. 2 is a front view of a refrigerator according to an embodiment of the disclosure.

As illustrated in FIG. 2, the refrigerator 1 may be partitioned to have the freezer compartment 11 and the refrigeration compartment 12. The evaporator 20 may be used to partition the refrigeration and freezer compartments 11, 12 rather than using a separate partition wall. In this instance, as shown in FIG. 2, a surface of the evaporator 20 may be exposed to a top region of the refrigeration compartment 12. The PCM casing 30 may be provided on the top and lateral surfaces of the evaporator 20 facing toward the freezing compartment 11 and the PCM casing 35 may be provided on the bottom surface of the evaporator 20 facing the refrigeration compartment 12.

Figure 5:
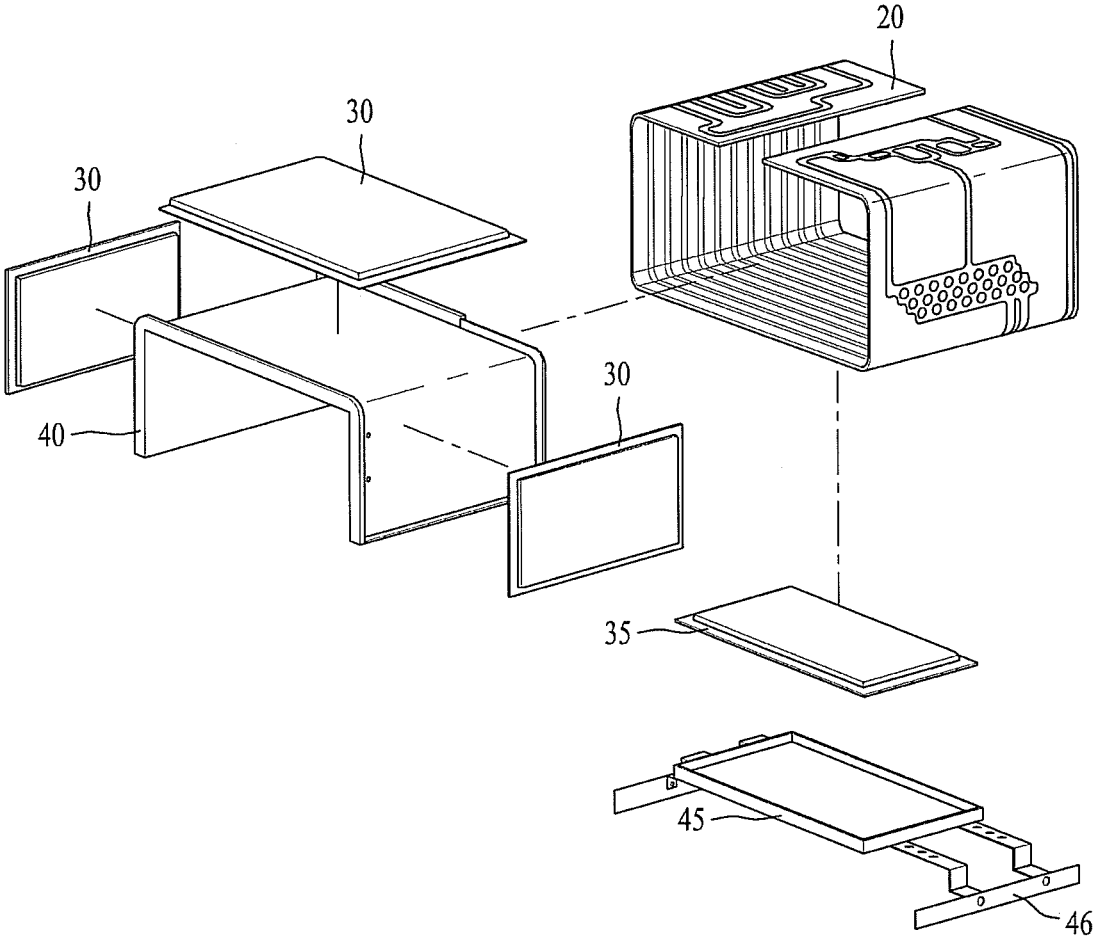
FIG. 5 is an exploded perspective view of an enclosure for a phase change material, an evaporator and frame for a phase change material according to one embodiment of the disclosure.

In this instance, the PCM casing 35 may be located between the freezer compartment 11 and the refrigeration compartment 12 and may be arranged on the refrigeration compartment 12 side of the evaporator 20 as shown in FIGS. 2 and 5, not toward the freezer compartment 11. In other words, the PCM casing 35 may be positioned to undergo heat exchange with the evaporator 20 to provide auxiliary cooling for the refrigeration compartment 12. Moreover, the PCM casing 35 may be a part of the structure that partitions the inner compartment of the refrigerator into the freezer compartment 11 and the refrigeration compartment 12.

Next, a PCM frame 40 and 45 may be provided to support the PCM casing 30 and 35 such that it contacts the evaporator 20 as well as to form an inner wall of the freezer compartment 11 or the refrigeration compartment 12. In this instance, the PCM frame 40 may be arranged on the top and lateral surfaces of the freezer compartment 11. Also, the PCM frame 45 may form a top surface of the refrigeration compartment 12.

The PCM casing 30, 35 may be arranged between the PCM frame 40, 45 and the evaporator 20. A predetermined gap may be provided between the PCM frame 40, 45 and the evaporator 20 to accommodate and support the PCM casing 30, 35. Accordingly, the PCM casing 30, 35 may prevent distortion of the PCM casing 30, 35 to ensure that the PCM casing 30, 35 maintains contact with the evaporator 20. For example, as the PCM casing 30, 35 may be formed of a flexible material, a shape of the PCM casing 30, 35 may be distorted as the PCM changes states. That is, when the PCM changes state to a liquid, a greater amount of PCM may accumulate at the bottom portion of the casing 30, 35 due to gravity. In this case, the surface of the PCM casing near the top may separate from the evaporator 20. Hence, the PCM frame 40, 45 may be provided to support the PCM casing 30, 35 to prevent distortions and to maintain contact with the evaporator 20.

Moreover, the gap provided between the PCM frame 40, 45 and the evaporator 20 may be determined to sufficiently press the PCM casing 30, 35 toward the evaporator 20 to ensure that the flexible surface of the casing 30, 35 conforms to the shape of the evaporator 20. The gap may also provide a tolerance for changes in volume of the PCM during phase changes.

The PCM casing 30, 35 formed of a flexible or pliable material such as vinyl may be damaged during normal use of the refrigerator as the PCM casing 30, 35 may be exposed to the storage compartments 11, 12. Accordingly, the PCM frame 40, 45 may cover the PCM casing 30, 35 to prevent exposure to the user or stored items. The surfaces of the PCM frame 40, 45 may serve as the inner surfaces of the respective sides of the storage chambers 11, 12. Moreover, the PCM frame 40, 45 may be formed of a hard or rigid material such as injection molded ABS to protect as well as support the PCM casing 30, 35.

Meanwhile, the rigidity of the PCM frame 40, 45 may be stronger than that of the PCM casing 30, 35. In other words, the PCM frame 40, 45 may be less flexible or malleable than the PCM casing 30 and 35 in order to support the PCM casing 30 and 35 stably.

As a result, the surface of the PCM casing 30, 35 may be in contact with the evaporator 20 and the opposite surface thereof may be in contact with the PCM frame 40, 45, such that the PCM casing 30, 35 is not be exposed to the user, reducing the possibility of damage to the PCM casing 30, 35. The PCM frame 40, 45 may be exposed to the user to form the inner wall of the storage compartment, specifically, the freezer compartment 11 or the refrigeration compartment 12.

As illustrated in FIGS. 2 and 5, when the plurality of the PCM casings 30 are arranged on the surfaces of the evaporator 20 (for example, the top and lateral surfaces), the plurality of the PCM casings 30 may be integrally formed with each other to reduce possibility of exposure of the PCM casings 30 and to form the wall surface of the storage compartment while having less connections. The integrally formed PCM casings 30 may reduce the number of components required in the refrigerator 1.

Moreover, the PCM frame 45 provided between the refrigeration compartment 12 and the freezer compartment 11 to cover the PCM casing 35 that is in contact with a surface of the evaporator 20 may be in contact with the exposed surface of the PCM casing 35 (e.g., the outer surface that faces the refrigeration compartment). As illustrated in FIGS. 2 and 5, the PCM frame 45 may be arranged under the PCM casing 35 coupled under the evaporator 20 to support the phase change casing 35. The PCM frame 45 may form the upper inner surface of the refrigeration compartment 12.

While the inner bottom surface of the evaporator 20 that faces the freezer compartment 11 is disclosed as not having a PCM casing 30 attached thereto, it should be appreciated that the present disclosure is not limited thereto. A PCM casing 30 may be provided on the inner bottom surface of the evaporator 20 in addition to PCM casing 35 provided on the outer bottom surface of the evaporator 20. The exposed surface of PCM casing 30 on the inner bottom surface of the evaporator 20 may serve as the bottom surface of the freezer compartment 11. Moreover, frame 40 may be provided to cover the PCM casing 30 for support as well as to serve as the bottom inner surface of the freezer compartment.

FIG. 5 illustrates the assembly of the PCM casing 30 and the PCM frame 40 to the evaporator 20. The PCM casing 30 in contact with the top and lateral surfaces of the evaporator 20 may be positioned within the evaporator 20, that is, adjacent to the inner wall of the evaporator 20 that faces the freezer compartment 11. The PCM frame 40 may be arranged to cover the PCM casing 30.

The PCM casing 35 may be positioned between the freezer compartment 12 and the freezer compartment 11 to contact with the evaporator 20. The PCM casing 35 may be arranged at the inner or outer surface of the evaporator 20, e.g., either inside or outside the freezing compartment 11. According to the embodiment of FIG. 5, the PCM casing 35 may be coupled to the outside surface of the evaporator 20, that is, the surface that faces the refrigeration compartment 12. The PCM frame 45 covering the PCM casing 35 may support the PCM casing 35.

Figure 6:
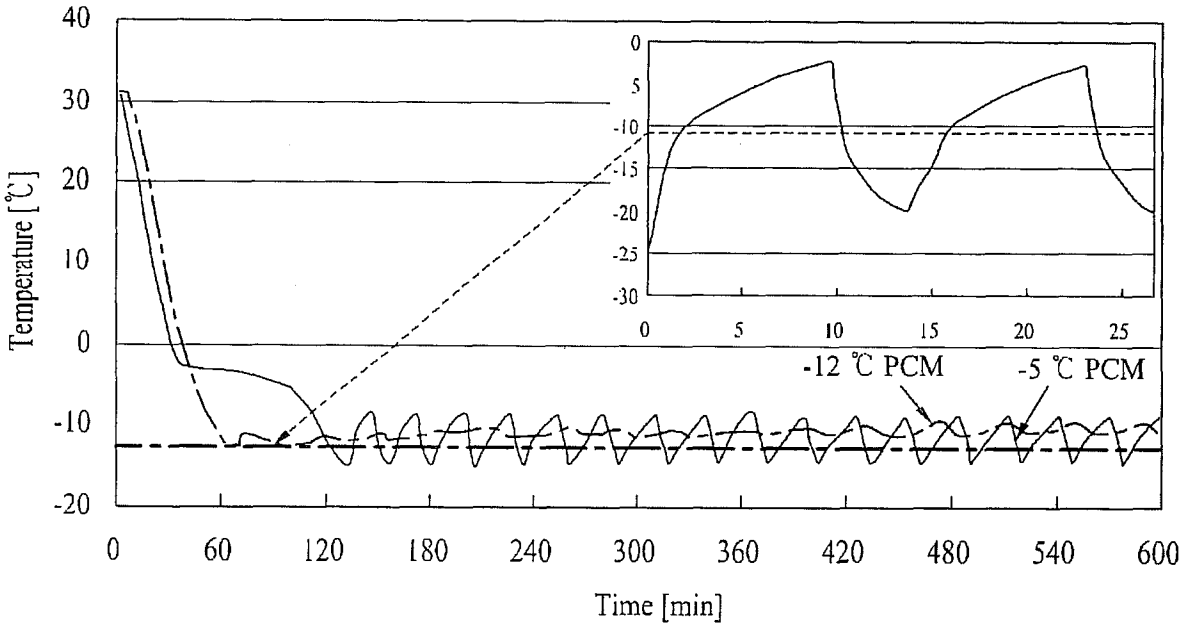
FIG. 6 is a graph that illustrates a change in temperature of a phase change material over time for a prescribed average temperature of the evaporator.
Figure 7:
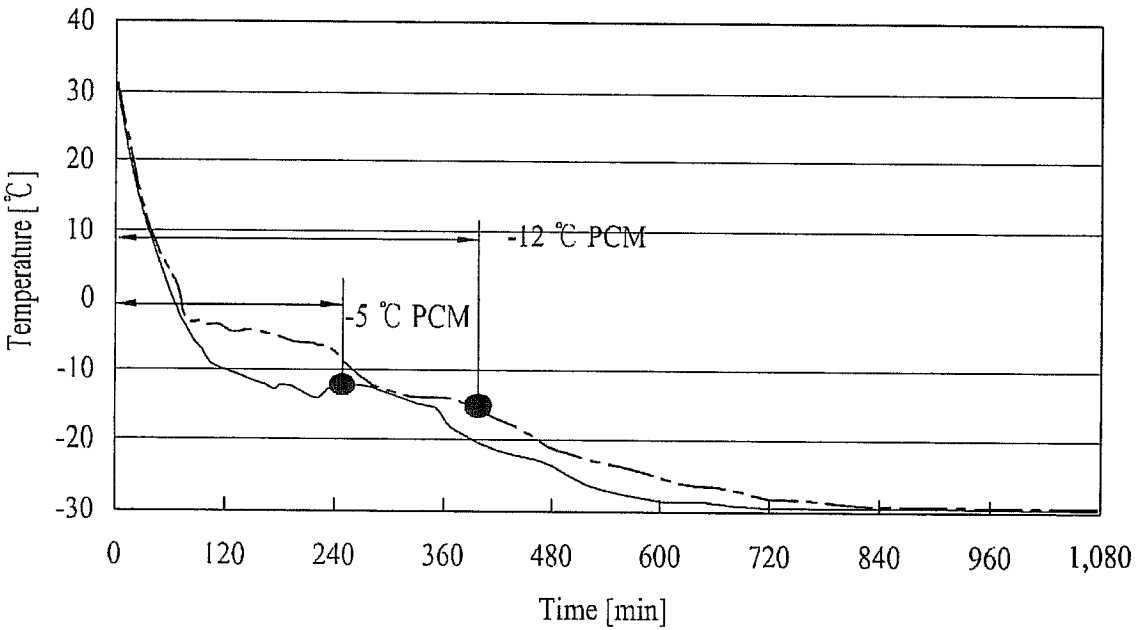
FIG. 7 is a graph that illustrates a change in temperature of phase change materials having different phase change temperatures over time.
Figure 8:
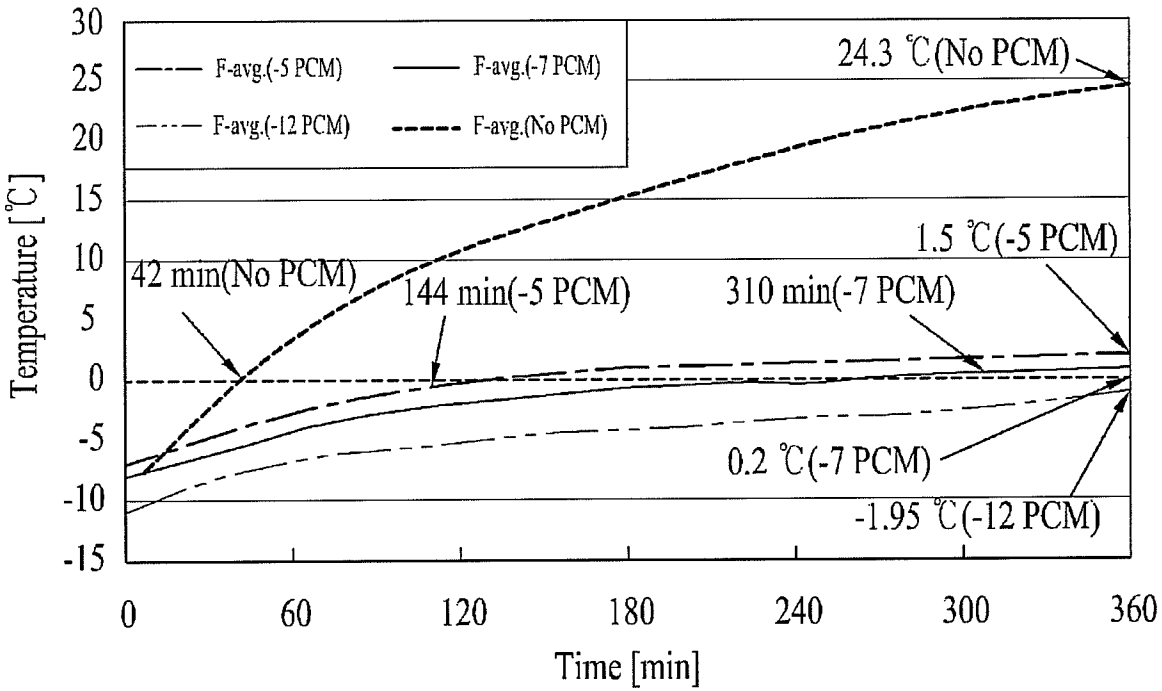
FIG. 8 is a graph that illustrates a change in temperature inside a freezer compartment having different types of phase change materials.

FIGS. 6 to 8 are graphs that illustrate a phase change temperature of the PCM with respect to time. The phase change temperature may refer to the temperature at which the PCM changes state. When the temperature reaches the phase change temperature, a rate of temperature change of the PCM rises to absorb or emit the latent heat and a phase of the PCM is changed.

When the refrigerator 1 is put into operation, the phase of the PCM is changes from a liquid to a solid to absorb the cold air exhausted from the evaporator 20. While absorbing the cold air, the temperature of the PCM falls. When the phase change temperature of the PCM is reached, a slope of the temperature change in the PCM may decrease.

The phase of the PCM may change from a liquid to a solid, or vice versa, over a temperature range of the storage compartment of the refrigerator 1. In other words, the phase of the PCM may be changed within a range of refrigerator inner temperatures preset or set by the user such that sufficient cold air may accumulate to ensure the phase change of the PCM.

Meanwhile, the phase of the PCM may be changed at a temperature that is lower than a temperature outside the storage compartment. If the phase change is performed at a temperature that is higher than the outdoor temperature of the storage compartment, the inside of the storage compartment has to have the temperature higher than the outdoor temperature of the storage compartment to enable the exhaustion of the cold air generated by the phase change of the PCM. Accordingly, the conditions mentioned above may be satisfied to utilize the cold air generated by the phase change of the PCM sufficiently.

FIG. 6 is a graph illustrating a change in temperature of the phase change material when an average temperature of the evaporator is −11° C. (−51.8° F.). FIG. 6 shows a change in temperatures of a first PCM having a phase change temperature of −12° C. (53.6° F.) (dotted line) and a second PCM having a phase change temperature of −5° C. (−41° F.) (solid line). As illustrated, the slope of the second PCM decreases at approximately −5° C. The phase of the PCM is changed from a liquid to a solid near approximately −5° C. which corresponds to the phase change temperature. At the range around the phase change temperature, a large amount of energy is stored in the PCM.

Meanwhile, the phase of the first PCM changes at a predetermined temperature (e.g., −12° C.) that is lower than the temperature of the evaporator 20 (e.g., −11° C.). When the phase change temperature is lower than the temperature of the evaporator 20 the PCM does not completely change phase from a liquid to a solid.

When the temperature of the evaporator 20 fluctuates at predetermined intervals, the pattern of change in temperature of the first PCM may be different from that of the second PCM near the average temperature of the evaporator 20 (e.g., −11° C.). The first PCM (−12° C.) is fluidal or partially liquid, and hence the changes in temperature of the first PCM is subtle. In contrast, the second PCM (−5° C.) is a solid, and hence the changes in temperature of the second PCM relative to the change in temperature of the evaporator 20 is more drastic.

In other words, when the phase change temperature of the PCM is lower than the temperature of the evaporator 20, the PCM will be solid without phase change and the cold air cannot be preserved. The phase of the PCM may be changed at a higher temperature than the average temperature of the evaporator 20. The temperature of the evaporator 20 may range between 0° C. to −18° C.

FIG. 7 is a graph illustrating a cold air reserving (storing) effect of the PCM according to the phase change temperature of the PCM. The phase of the first PCM having the phase change temperature of −12° C. (dotted line) may be completely changed approximately in 400 minutes. The phase of the second PCM having the phase change temperature of −5° C. (solid line) may be completely changed approximately in 250 minutes. The time period to complete the phase change is related to the ability of the PCM to store the cold air. A longer time period required to complete the phase change corresponds to a better cold air storing ability. Accordingly, the PCM having a lower phase change temperature may be used.

As described in reference to FIGS. 6 and 7, it may be desirable that the PCM have a lower phase change temperature, while being higher than the average temperature of the evaporator 20.

FIG. 8 is a graph illustrating a change in temperature inside the freezer compartment according to the phase change temperature of the PCM. The temperature inside the freezer compartment rises at a slower rate with PCM than without PCM. That is, a slope of the temperature increase in the freezing compartment may be less when the PCM is used, compared with when the PCM is not used, as illustrated.

When the PCM is not used, the time period for the temperature of the freezer compartment 11 to reach approximately 0° C. may be approximately 42 minutes. When a PCM having the phase change temperature of −5° C. is used, the time period may be approximately 144 minutes. When a PCM having the phase change temperature of −7° C. (−44.6° F.) is used, the time period may be approximately 310 minutes. When a PCM having the phase change temperature of −12° C. is used, the temperature of the freezer compartment 11 may not reach 0° C. after 6 hours. As described in reference to FIGS. 6 and 7, as the phase change temperature of the PCM decreases, the cold air storing ability may improve and the temperature maintaining effect of the storage compartment may also be improved.

As illustrated in the graphs of FIGS. 6 to 8, a lower phase change temperature of the PCM may be desired. However, the phase change temperature of the PCM must be higher than the average temperature of the evaporator 20. Accordingly, a lower limit of the phase change temperature has to be −10° C. (−50° F.) or higher such that it is higher than, for example, −11° C., the average temperature of the evaporator 20 according to an embodiment as broadly described herein. In certain embodiments, the temperature of the evaporator 20 may range between 0° C. to −18° C.

Also, a PCM may be selected that can maintain a temperature at or below 0° C. for a predetermined amount of time. The operational duration of the PCM may be based on the length of an anticipated power supply failure, for example. When the predetermined amount of time is, for example, 2 hours, a PCM may be used that can maintain a temperature at or below 0° C. for at least 2 hours. Accordingly, referring to FIG. 8, a PCM having a phase change temperature of at least −5° C. may be used. In other words, the proper phase change temperature of the PCM may be in a range of −5° C. to −10° C.

As broadly described and embodied herein, a refrigerator may include an auxiliary cooling device having a phase change material. A PCM enclosure may be provided to increase the contact area with the evaporator 20, and hence, the heat exchange efficiency between the PCM and the evaporator 20 may be enhanced. As the heat exchange efficiency is enhanced, the amount of time required for the PCM to undergo a phase change may be reduced and the amount of time required to store cold air energy may be reduced accordingly. Furthermore, damage to the PCM and the PCM casing 30 and 35 may be prevented and the durability of the refrigerator 1 may be enhanced.

In one embodiment, a refrigerator may include a cabinet having a storage compartment to preserve food, a pipe for refrigerant arranged in the storage compartment to cool the storage compartment, a phase change material to provide auxiliary cooling for the storage compartment when the pipe is not operational, and an enclosure for the phase change material provided around the pipe, wherein the pipe has a serpentine shape and the enclosure is formed of a flexible material and shaped to corresponding to a shape of the pipe.

A surface of the phase change material enclosure that corresponds to the evaporator may be more flexible than a surface of the phase change material enclosure that corresponds to the storage compartment. A phase change material frame may be provided to support the phase change material enclosure to the evaporator, the phase change material being positioned a predetermined distance from the evaporator such that the phase change material enclosure is positioned between the phase change material frame and the evaporator. A phase change material frame may be provided to mount the phase change material enclosure to the evaporator such that the phase change material enclosure is pressed against the evaporator. A phase change material frame may be arranged on a surface of the phase change material enclosure facing the storage compartment, the phase change material frame forming an inner wall of the storage compartment.

A plurality of the phase change material enclosures may be provided, and the phase change material frame supports the plurality of the phase change material enclosures. The phase change material frame may be less flexible than a surface of the phase change material enclosure. The phase change material enclosure may be formed of vinyl.

A phase of the phase change material may be configured to change at a prescribed temperature greater than or equal to a set temperature of the refrigerator. A phase of the phase change material may be configured to change at a prescribed temperature greater than or equal to an average temperature of the evaporator. A temperature at which the phase of the phase change material changes may be greater than or equal to −10° C. A temperature at which the phase of the phase change material is configured to change may be less than a temperature outside of the storage compartment.

The phase change material may maintain the temperature of the storage compartment to be less than or equal to 0° C. for a prescribed amount of time when a cooling cycle of the refrigerator is not operational. A temperature at which the phase of the phase change material may be configured to change is less than or equal to −5° C. Moreover, a temperature at which the phase of the phase change material may be configured to change is in a range of −10° C. to −5° C.

In one embodiment, a refrigerator may include a cabinet that includes a storage compartment to preserve food, an evaporator arranged in the storage compartment to cool to the storage compartment, a phase change material to provide auxiliary cooling for the storage compartment when the evaporator is not operational, an enclosure for the phase change material provided adjacent to the evaporator, wherein the evaporator includes a serpentine pipe and the enclosure is formed of a flexible material and shaped to correspond to a shape of the pipe; and a frame for the phase change material provided to support the phase change material enclosure.

The phase change material enclosure may conform to a prescribed shape of a surface of the evaporator. A rigidity of the phase change material frame may be greater than a rigidity of the phase change material enclosure.

In one embodiment, a refrigerator may include a cabinet that includes a storage compartment to preserve food, an evaporator to cool the storage compartment, a phase change material to provide auxiliary cooling for the storage compartment when the evaporator is not operational, and an enclosure for the phase change material provided adjacent to the evaporator, wherein the evaporator includes a serpentine pipe and the enclosure is formed of a flexible material and shaped to correspond to a shape of the pipe, wherein a phase of the phase change material is configured to change at a prescribed temperature greater than or equal to an average temperature of the evaporator.

A temperature of the evaporator may range between 0° C. to −18° C., and wherein a phase of the PCM is configured to change at a prescribed temperature between −5° C. to −10° C. The phase change material may maintain a temperature of the storage compartment to be less than or equal to 0° C. for a prescribed amount of time when the evaporator is not operational.

In one embodiment, a refrigerator may include a refrigerator cabinet comprising a storage compartment to preserve foods; an evaporator arranged in the storage compartment to supply cold air to the storage compartment; and a phase change material receptor having a phase change material injected therein, the phase change material receptor comprising a surface that is transformable corresponding to a shape of the evaporator.

The phase change material receptor may include the other surface located in opposite to the evaporator and the surface may be more flexible than the other surface of the phase change material receptor. The refrigerator may further include a phase change material frame to fix the phase change material receptor to enable the phase change material receptor to be received in a predetermined gap formed with the evaporator. The refrigerator may further include a phase change material frame to fix the phase change material receptor to enable the evaporator to press a surface of the phase change material. The refrigerator may further include a phase change material frame arranged on the other surface of the phase change material receptor, the phase change material frame forming an inner wall of the storage compartment. The plurality of the phase change material receptors may be provided, and the phase change material frame may support the plurality of the phase change material receptors.

The phase change material frame may be less transformable than a surface of the phase change material receptor. The phase change material receptor may be formed of vinyl. A phase of the phase change material may be changed at a settable refrigerator inner temperature or higher. A phase of the phase change material may be changed at an average temperature of the evaporator or higher. A phase change temperature of the phase change material may be −10° C. or higher.

A phase of the phase change material may be changed at a lower temperature than an outdoor temperature of the storage compartment. The phase change material may maintain the temperature of the storage compartment at 0° C. or lower in a reference time, when a cooling cycle of the refrigerator is not operated. A phase change temperature of the phase change material may be −5° C. or lower. The phase change temperature of the phase change material may be in a range of −10° C. to −5° C.

In another aspect of the disclosure, a refrigerator may include a refrigerator cabinet including a storage compartment to preserve foods; an evaporator arranged in the storage compartment to supply cold air to the storage compartment; a phase change material receptor having a phase change material (PCM) injected therein, the phase change material receptor comprising a surface that is transformable corresponding to a shape of the evaporator; and a phase change material frame arranged on the other surface of the phase change material receptor to support the phase change material receptor.

The phase change material receptor may be transformable according to unevenness formed in the evaporator. A rigidity of the phase change material frame may be stronger than a rigidity of the phase change material receptor.

In a further aspect of the disclosure, a refrigerator may include a refrigerator cabinet comprising a storage compartment to preserve foods; an evaporator to supply cold air to the storage compartment; and a phase change material receptor having a phase change material injected therein, the phase change material receptor comprising a surface that is transformable corresponding to a shape of the evaporator, wherein a phase of the phase change material is changed at an average temperature of the evaporator or higher. Moreover, the phase change material may maintain the temperature of the storage compartment at 0° C. or lower in a reference time, when the evaporator does not supply cold air.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator having auxiliary cooling device comprising:

a cabinet that includes a storage compartment to preserve food;

an evaporator arranged in the storage compartment to cool the storage compartment, the evaporator being coupled to the cabinet and having a top, bottom and lateral surfaces;

a phase change material (PCM) to provide auxiliary cooling for the storage compartment when the evaporator is not operational;

a PCM casing to hold the PCM, the PCM casing being formed of a flexible material; and a PCM frame to support the PCM casing in the evaporator, wherein the PCM casing is arranged between the PCM frame and the evaporator to ensure that the PCM casing maintains contact with the evaporator.

2. The refrigerator according to claim 1, wherein a surface of the PCM casing that corresponds to the evaporator is more flexible than a surface of the PCM casing that corresponds to the PCM frame.

3. The refrigerator according to claim 1, wherein the PCM casing is formed of vinyl.

4. The refrigerator according to claim 1, wherein the refrigerator is partitioned to have a freezer compartment of the storage compartment and a refrigeration compartment of the storage compartment, and wherein the bottom surface of the evaporator is exposed to a top region of the refrigeration compartment.

5. The refrigerator according to claim 1, wherein the PCM frame is arranged in the top and lateral surfaces of the evaporator.

6. The refrigerator according to claim 5, wherein the PCM casing is in contact with the top and lateral surfaces of the evaporator and the PCM frame is arranged to cover the PCM casing.

7. The refrigerator according to claim 6, wherein a plurality of the PCM casings are provided, and the PCM frame supports the plurality of the PCM casings.

8. The refrigerator according to claim 7, wherein the plurality of the PCM casings are integrally formed with each other.

9. The refrigerator according to claim 1, further comprises:

another PCM casing; and another PCM frame arranged under the bottom surface of the evaporator, wherein the another PCM casing is arranged between the bottom surface of the evaporator and the another PCM frame.

10. The refrigerator according to claim 1, wherein the PCM frame is formed of injection molded ABS to protect and support the PCM casing.

11. The refrigerator according to claim 1, wherein the PCM is configured to change at a prescribed temperature between −5° C. to −10° C.

12. A refrigerator partitioned to have a freezer compartment and a refrigeration compartment, comprising:

an evaporator to partition the freezer compartment and the refrigeration compartment, the evaporator having a top, bottom and lateral surfaces and the bottom surface of the evaporator being exposed to a top region of the refrigeration compartment;

a phase change material (PCM) to provide auxiliary cooling for the storage compartment when the evaporator is not operational;

a PCM casing to hold the PCM, the PCM casing being formed of a flexible material and being positioned within the evaporator; and a PCM frame to support the PCM casing within the evaporator, wherein the PCM casing is in contact with the top and lateral surfaces of the evaporator and the PCM frame is arranged to cover the PCM casing.

13. The refrigerator according to claim 12, wherein a gap is provided between the PCM frame and the evaporator to ensure that the PCM casing maintains contact with the evaporator.

14. The refrigerator according to claim 13, wherein the gap is predetermined to press the PCM casing toward the evaporator.

15. The refrigerator according to claim 14, wherein a plurality of the PCM casings are provided, and the PCM frame supports the plurality of the PCM casings.

16. The refrigerator according to claim 15, wherein the plurality of the PCM casings are integrally formed with each other.

17. The refrigerator according to claim 12, further comprising:

another PCM casing; and another PCM frame arranged under the bottom surface of the evaporator, wherein the another PCM casing is arranged between the bottom surface of the evaporator and the another PCM frame.

* * * * *